US012796818B2

(12) United States Patent
Hu

(10) Patent No.: US 12,796,818 B2
(45) Date of Patent: Nov. 17, 2026

(54) FOLDING CHAIR

(71) Applicant: NINGHAI SUPERSUN TOURIST GOODS CO., LTD., Ningbo (CN)

(72) Inventor: Junmin Hu, Ningbo (CN)

(73) Assignee: NINGHAI SUPERSUN TOURIST GOODS CO., LTD., Ningbo (CN)

( * ) Notice: Subject to any disclaimer, the term of this patent is extended or adjusted under 35 U.S.C. 154(b) by 80 days.

(21) Appl. No.: 18/900,873

(22) Filed: Sep. 29, 2024

(65) Prior Publication Data

US 2025/0235002 A1 Jul. 24, 2025

(30) Foreign Application Priority Data

Jan. 22, 2024 (CN) ..... 202420151010.4
May 28, 2024 (CN) ..... 202421189171.9

(51) Int. Cl.
*A47C 4/28* (2006.01)
*A47C 7/02* (2006.01)

(52) U.S. Cl.
CPC ..... *A47C 4/28* (2013.01); *A47C 7/021* (2013.01)

(58) Field of Classification Search
CPC .. A47C 4/28; A47C 4/30; A47C 4/286; A47C 7/021
See application file for complete search history.

(56) References Cited

U.S. PATENT DOCUMENTS 10,010,179 B1 * 7/2018 Stump ..... A47C 4/44
11,439,238 B1 * 9/2022 Wang ..... A47C 3/40
11,700,943 B1 * 7/2023 Wang ..... A47C 4/286 297/16.2
11,786,041 B1 * 10/2023 Chen ..... A47C 4/42 297/16.1
11,844,439 B1 * 12/2023 Wang ..... A47C 3/40
11,864,660 B1 * 1/2024 Wang ..... F16M 11/242
11,871,848 B1 * 1/2024 Wang ..... A47C 4/286
(Continued)

FOREIGN PATENT DOCUMENTS

CN 216961941 U 7/2022
CN 116869303 A * 10/2023 ..... A47C 4/04
(Continued)

OTHER PUBLICATIONS

Notice of Reasons for Rejection in Japanese Application No. 2025085185 mailed on Aug. 8, 2025, 12 pages.

*Primary Examiner* — William L Miller
(74) *Attorney, Agent, or Firm* — PORUS IP LLC

(57) ABSTRACT

The present disclosure provides a folding chair, comprising a chair fabric, a folding mechanism, and at least two support mechanisms. The folding mechanism includes a fixed portion and a movable portion that are rotationally connected with each other, and the at least two support mechanisms is connected with the fixed portion or the movable portion. The movable portion is capable of circumferentially rotating to an expanded dead center pattern or a collapsed dead center pattern relative to the fixed portion, so as to enable each of the at least two support mechanisms to expand to support the chair fabric or collapse to present a linear structure. The present disclosure has advantages of a simple and convenient structure, quick and effective for use, and a flexible switch between the rotation mode and a position-limitation mode.

20 Claims, 9 Drawing Sheets

(56) References Cited

U.S. PATENT DOCUMENTS

| | | | | |
|---|---|---|---|---|
| 11,937,709 | B2 * | 3/2024 | Xu | A47B 3/12 |
| D1,025,629 | S * | 5/2024 | Hu | D6/708 |
| 11,980,292 | B1 * | 5/2024 | Wang | A47C 7/14 |
| 11,980,296 | B2 * | 5/2024 | Kim | A47C 3/12 |
| 11,986,103 | B1 * | 5/2024 | Li | A47C 4/30 |
| 12,059,079 | B1 * | 8/2024 | Chen | A47C 4/286 |
| 12,127,687 | B1 * | 10/2024 | Zhang | A47C 4/30 |
| 12,185,831 | B2 * | 1/2025 | Xu | A47B 13/02 |
| 12,514,372 | B2 * | 1/2026 | Zhu | A47C 4/286 |
| 12,622,523 | B2 * | 5/2026 | Fischer | A47C 1/03255 |
| 2017/0181548 | A1 * | 6/2017 | Yoo | A47C 4/44 |
| 2017/0311723 | A1 * | 11/2017 | Lenhart | A47C 4/42 |
| 2018/0035806 | A1 | 2/2018 | Yang | |
| 2022/0386779 | A1 * | 12/2022 | Garcia | A47C 4/30 |
| 2023/0023969 | A1 * | 1/2023 | Zhu | A47C 4/286 |
| 2023/0172358 | A1 * | 6/2023 | Xu | A47C 9/105 297/16.2 |
| 2023/0200539 | A1 * | 6/2023 | Chen | A47C 3/18 297/47 |
| 2023/0320487 | A1 * | 10/2023 | Jin | A47C 4/286 297/16.2 |
| 2023/0371693 | A1 * | 11/2023 | Kim | A47C 4/286 |
| 2024/0138571 | A1 * | 5/2024 | Yuan | A47C 4/286 |
| 2024/0415286 | A1 * | 12/2024 | Zhu | A47C 4/286 |
| 2025/0107625 | A1 * | 4/2025 | Zhang | A47C 4/30 |
| 2025/0127304 | A1 * | 4/2025 | Tang | A47C 4/286 |
| 2025/0318646 | A1 * | 10/2025 | Zhang | A47C 4/286 |
| 2026/0047682 | A1 * | 2/2026 | Yang | A47C 4/286 |
| 2026/0083245 | A1 * | 3/2026 | Chen | A47C 4/286 |

FOREIGN PATENT DOCUMENTS

| | | | | |
|---|---|---|---|---|
| CN | 222584014 | U * | 3/2025 | |
| JP | 3252484 | U | 8/2025 | |
| JP | 7818313 | B2 | 2/2026 | |
| KR | 102327128 | B1 * | 11/2021 | A47C 7/002 |

* cited by examiner

FOLDING CHAIR

CROSS REFERENCE TO RELATED APPLICATIONS

This application claims priority to Chinese application No. 202420151010.4, filed on Jan. 22, 2024, and Chinese application No. 202421189171.9, filed on May 28, 2024, the entire contents of which are incorporated herein by reference.

TECHNICAL FIELD

The present application relates to the technical field of outdoor products, and in particular, to a folding chair.

BACKGROUND

A folding chair is a type of seat designed for easy transport and storage, featuring a foldable structure and seat fabric. The folding chair can be unfolded for a user to lie down, sit, or rest, and can also be folded up to save space, making it convenient to carry and store. Folding chairs are widely used in various situations, including outdoor activities, emergency rescue, temporary seating needs, camping, travel, and more.

However, existing folding chairs have the following drawbacks: various folding chairs have a larger volume and occupy more storage space after being folded due to their complex frameworks. On the other hand, various folding chairs have a smaller volume when folded, but they require reassembly when being folded or unfolded, with complicated assembly steps. This leads to the need for more time to assemble the chair before or after use. Chinese utility model patent application No. CN216961941U discloses a moon chair, which includes a seat surface and a frame. The frame consists of a support ring and a support base. The seat surface is fixedly connected with the support ring, while the support base is detachably connected with the support ring. The support base includes a front support frame, a connection rod, and a rear support frame. One end of the front support frame is detachably connected with the connection rod, and the other end of the rear support frame is detachably connected with the connection rod. By detaching the support ring from the support base, the folded chair occupies less space.

SUMMARY

One object of the present disclosure is to provide a folding chair that is convenient and quick to unfold and fold, in order to solve the problem that an existing folding chair needs to be assembled and disassembled when expanding for use or collapsing for storage.

In order to achieve the above purpose, the present disclosure provides a folding chair comprising a chair fabric, a folding mechanism, and at least two support mechanisms, wherein the folding mechanism includes a fixed portion and a movable portion that are rotationally connected with each other, and each of the at least two support mechanisms includes a connection rod, a lower support rod, and an upper support rod that are disposed on a same plane, one end of the connection rod is connected with the fixed portion or the movable portion, the other end of the connection rod is hingedly connected with the lower support rod, the upper support rod is hingedly connected with the lower support rod, the lower support rod is provided with an accommodation slot, and the movable portion is capable of circumferentially rotating to an expanded dead center pattern or a collapsed dead center pattern relative to the fixed portion, so as to enable each of the at least two support mechanisms to expand to support the chair fabric or collapse to present a linear structure;

when the folding mechanism is in the expanded dead center pattern, the lower support rod is disposed diagonally downwardly, and the upper support rod is disposed diagonally upwardly to support the chair fabric; and when the folding mechanism is in the collapsed dead center pattern, the upper support rod is collapsed into the accommodation slot and rotationally affixed to the connection rod with the lower support rod.

In some embodiments, the lower support rod is hingedly connected with the connection rod to form a first hinge point, the lower support rod is hingedly connected with the upper support rod to form a second hinge point, and the first hinge point and the second hinge point are located at a same end portion of the lower support rod such that a direction of rotation and folding of the lower support rod relative to the connection rod is the same as a direction of rotation and folding of the upper support rod relative to the connection rod.

In some embodiments, the connection rod includes a support crossbar and a connection seat, the connection seat including a first end portion extending along a horizontal direction and a second end portion extending obliquely downward, an obtuse angle being formed between the first end portion and the second end portion, the support crossbar being connected with the first end portion, the lower support rod being hingedly connected with the second end portion, and when the support mechanism is collapsed, the lower support rod and the upper support rod being rotatably folded inwardly to the underside of the support crossbar and being affixed to the support crossbar.

In some embodiments, the second end portion is provided with a position-limiting tab, the position-limiting tab being adapted to engage the lower support rod to limit a maximum expanded position of the lower support rod, such that when the lower support rod is at the maximum expanded position, the lower support rod and the second end portion are in a same straight line.

In some embodiments, the second end portion is provided with a position-limiting recessed slot, a shape of the position-limiting recessed slot being adapted to a shape of the upper support rod, so that when the upper support rod rotates to a maximum expanded position, the upper support rod is adapted to be embedded in the position-limiting recessed slot and abuts against the position-limiting recessed slot to limit the maximum expanded position of the upper support rod.

In some embodiments, the lower support rod is provided with a socket buckle, the socket buckle being provided with a snap-fit protrusion, the snap-fit protrusion being detachably snap-fitted with the upper support rod and being configured to retain the upper support rod within the accommodation slot when an external force does not exceed a preset value.

In some embodiments, the upper support rod is configured as a single-tube structure with a fixed length; or the upper support rod is configured as a multi-tube structure with an adjustable length.

In some embodiments, the chair fabric is provided with one or more mounting members, such that when the folding mechanism is in the expanded dead center pattern, each of the at least two support mechanisms is expanded, each of the one or more mounting members and each upper support rod are detachably connected and disposed on the each of the at least two support mechanisms, and the chair fabric is configured to exert a force on a connection end of the each upper support rod and the each of the one or more mounting members to hold the upper support rod at a maximum expanded position.

In some embodiments, the chair fabric includes a seat cushion portion and a backrest portion, the seat cushion portion and the backrest portion being provided with the one or more mounting members, the upper support rod connected with the mounting member on the seat cushion portion being configured as the single-tube structure with the fixed length, the upper support rod connected with the mounting member on the backrest portion being configured as the multi-tube structure with the adjustable length, and a maximum expanded length of the upper support rod of the multi-tube structure is greater than a maximum expanded length of the upper support rod of the single-tube structure.

In some embodiments, a length D of the lower support rod, a length L of the upper support rod of the single-tube structure, and a minimum length S of the upper support rod of the multi-tube structure are not greater than a distance M between the two first hinged points in the two support mechanisms symmetrically disposed at two ends of the folding mechanism when the each of the two support mechanisms is in a linear structure.

In some embodiments, a position-limiting block is movably disposed on the fixed portion, the position-limiting block being configured to be embedded into a position-limiting slot for circumferentially limiting a position of the movable portion when the movable portion is in the expanded dead center pattern or the collapsed dead center pattern to maintain the folding mechanism in the expanded dead center pattern or the collapsed dead center pattern.

In some embodiments, the folding mechanism includes a resilient member, the resilient member being disposed between the fixed portion and the position-limiting block, one end of the resilient member being fixedly connected with the fixed portion, and the other end of the resilient member being fixedly connected with the position-limiting block, the resilient member being configured to drive the position-limiting block to move upwardly to enable the position-limiting block to enter the position-limiting slot under an action of the resilient member when the position-limiting block and the position-limiting slot are in proper alignment; and the position-limiting block is capable of moving downwardly to compress the resilient member and disengage from the position-limiting slot under an action of an external force.

In some embodiments, the position-limiting block includes a position-limiting portion, a pressing portion located at an upper end of the position-limiting portion, and a connection portion located at a lower end of the position-limiting portion, the connection portion being of a cylindrical structure and being internally hollow to form a cavity for accommodating the resilient member, whereby one end of the resilient member is disposed within the cavity, and the other end of the resilient member is disposed in the fixed portion, and the pressing portion is used to be pressed or released to cause the position-limiting portion to move downwardly out of the position-limiting slot or upwardly embedded within the position-limiting slot.

In some embodiments, horizontal projections of the position-limiting portion and the position-limiting slot are in forms of an adapted polytope or ellipse.

In some embodiments, a cover plate is disposed on a top of the fixed portion, the cover plate is provided with a letting opening, and a shape of the letting opening fits with the pressing portion, whereby only the pressing portion in the position-limiting block is capable of extending through the letting opening to a top of the cover plate, and the position-limiting portion is limited within the position-limiting slot by abutting against the cover plate.

In some embodiments, the folding mechanism includes two fixed connection blocks and two rotating connection blocks, the two fixed connection blocks being mounted on the fixed portion, the two rotating connection blocks being mounted on the movable portion; when the movable portion rotates relative to the fixed portion so that the folding mechanism is in the expanded dead center pattern, the two fixed connection blocks and the two rotating connection blocks are combined to form an X-shaped structure, and the position-limiting block and the position-limiting slot are in proper alignment; and when the movable portion rotates relative to the fixed portion so that the folding mechanism is in the collapsed dead center pattern, the fixed connection block and the rotating connection block are combined to form a linear structure, the position-limiting block and the position-limiting slot being in proper alignment.

In some embodiments, the fixed portion includes a chassis portion, the chassis portion being provided with at least one vertical projection portion extending upwardly on an outer edge of the chassis portion, the movable portion including an insertion portion, an outer wall of the insertion portion being provided with at least one horizontal projection portion outwardly extending; the insertion portion being rotatably mounted on the chassis portion, and when the insertion portion rotates relative to the chassis portion, the at least one horizontal projection portion being close to or away from the at least one vertical projection portion.

In some embodiments, when the at least one horizontal projection portion abuts against the at least one vertical projection portion, the at least one horizontal projection portion and the at least one vertical projection portion cooperate to limit a relative rotation of the chassis portion and the insertion portion, the folding mechanism is in the expanded dead center pattern or the collapsed dead center pattern, and the position-limiting block and the position-limiting slot are in proper alignment.

In some embodiments, two vertical projection portions are disposed on the chassis portion, each of the two vertical projection portions is provided with a fixed connection block, two horizontal projection portions are disposed on the insertion member, each of the two horizontal projection portions is provided with a rotating connection block; when the folding mechanism is in the expanded dead center pattern, two fixed connection blocks are disposed at a front end and a rear end of the chassis portion, respectively, and two rotating connection blocks are disposed at a left end and a right end of the chassis portion, respectively, thus forming an X-shaped structure; when the folding mechanism is in the collapsed dead center pattern, the two fixed connection blocks are disposed at the front end and the rear end of the chassis portion, respectively, and the two rotating connection blocks are disposed at the front end and the rear end of the chassis portion, respectively, thus forming a linear structure.

In some embodiments, the chassis portion is provided with a recessed slot, projections of the recessed slot and the insertion section are in forms of a square circle, and a lower end of the insertion portion is inserted into the recessed slot to rotatably connect the insertion portion with the chassis portion.

Compared to the prior art, the present disclosure has following beneficial effects.

(1) The support mechanism of the folding chair of the present disclosure includes a connection rod, a lower support rod and an upper support rod disposed on a same plane, the lower support rod is hingedly connected with the connection rod, the upper support rod is hingedly connected with the lower support rod, and the lower support rod is provided with an accommodation slot for accommodating the upper support rod, when the support mechanism is folded, the upper support rod can be rotated and folded into the accommodation slot, and further rotated and folded together with the lower support rod to be affixed to the connection rod. The support mechanism has a simple structure and few parts, which simplifies a manufacturing process and reduces a manufacturing cost, and the folded support mechanism has a small and compact volume and occupies less space, which is convenient for a user to carry and store, and the user only needs to rotate the upper support rod and the lower support rod when unfolding and folding the support mechanism, and there is no need to disassemble or install the upper support rod and the lower support rod, which improves the convenience of using the support mechanism; and (2) The folding mechanism of the folding chair of the present disclosure is provided with a position-limiting block and a position-limiting slot, and horizontal projections of the position-limiting block and the position-limiting slot is in a form of an adaptable polygon or ellipse. Therefore, when the position-limiting block is placed in the position-limiting slot, the position-limiting block and the position-limiting slot can cooperate with each other to realize circumferential position-limitation, and when the position-limiting block is disengaged from the position-limiting slot, the position-limitation is lifted, and both the position-limiting block and the position-limiting slot can rotate relative to each other flexibly and smoothly, which has advantages of a simple and convenient structure, quick and effective for use, and a flexible switch between the rotation mode and a position-limitation mode.

Figure 1:
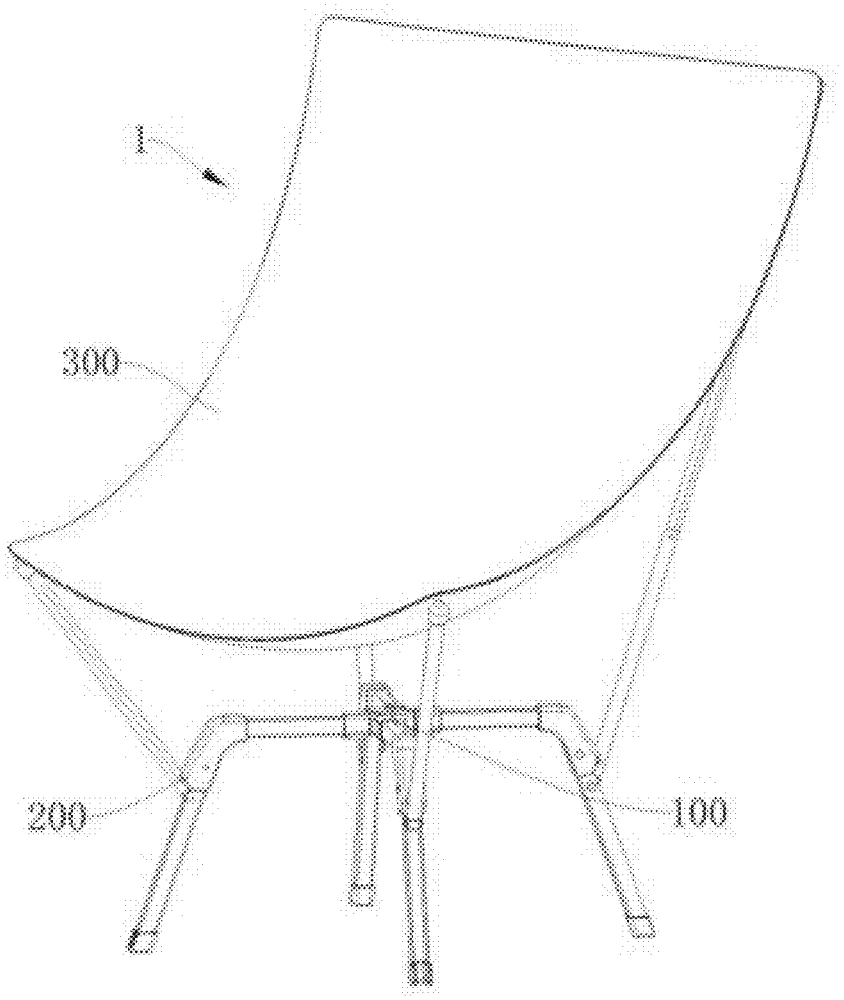
FIG. 1 is a schematic diagram illustrating an exemplary structure of a folding chair according to some embodiments of the present disclosure.
Figure 2:
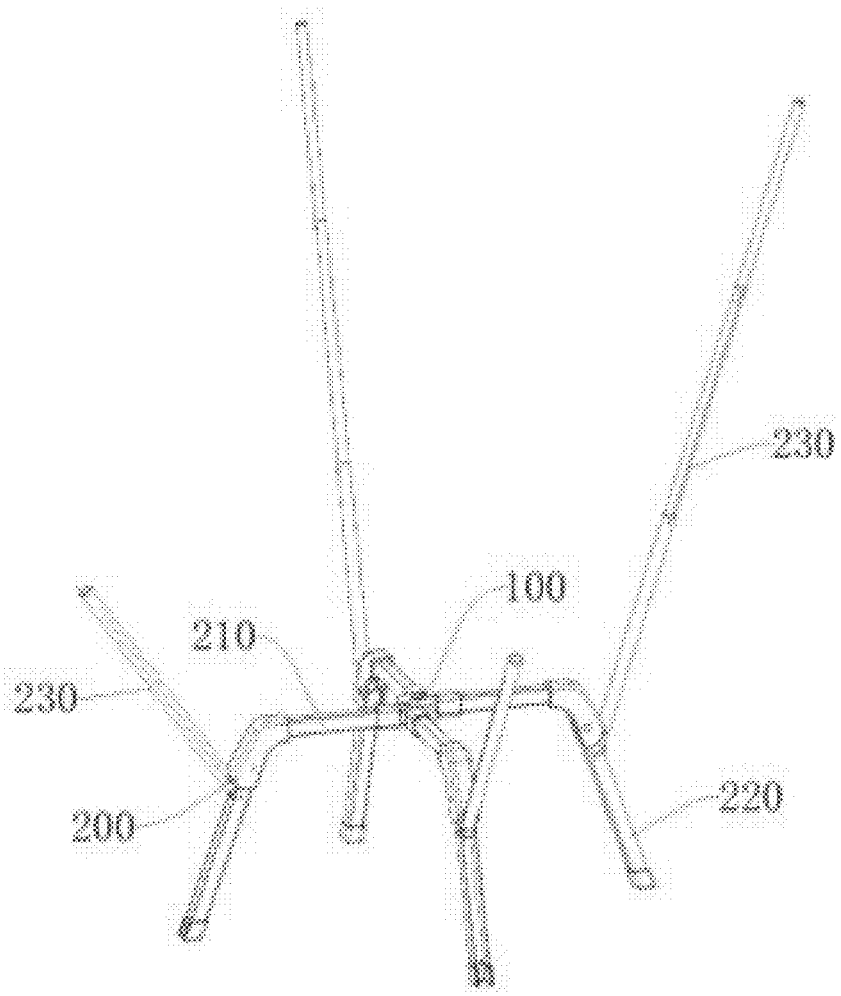
FIG. 2 is a schematic diagram illustrating an exemplary structure of an unfolded folding chair (without a chair fabric) according to some embodiments of the present disclosure.
Figure 3:
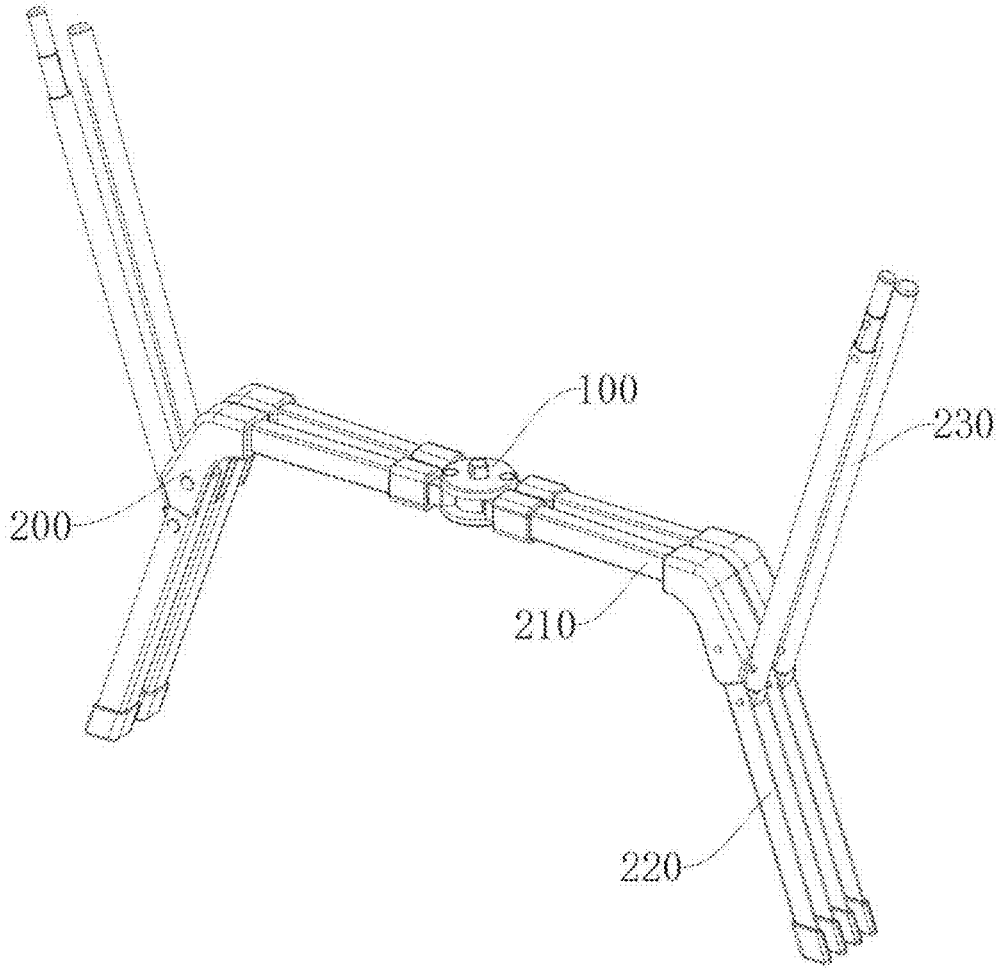
FIG. 3 is a schematic structural diagram illustrating an exemplary structure of a folding chair (without a chair fabric) in a folded intermediate state according to some embodiments of the present disclosure.
Figure 4:
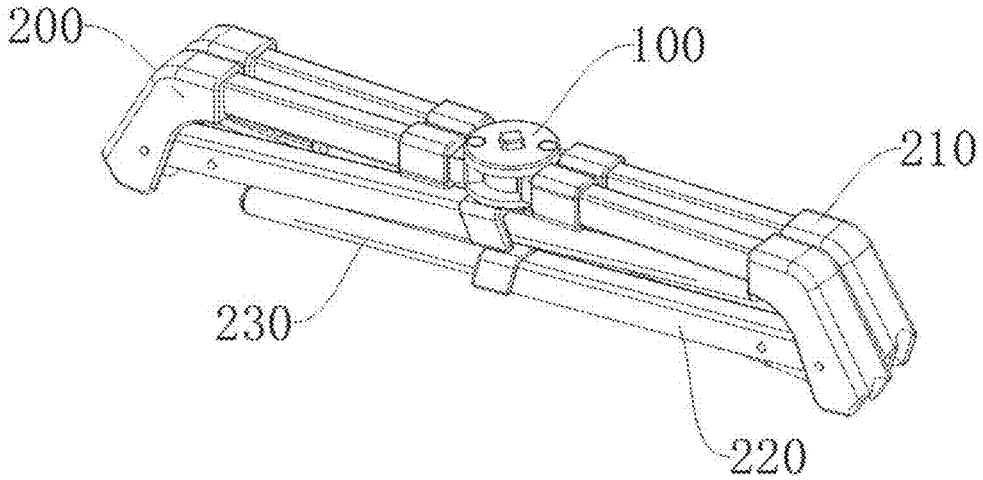
FIG. 4 is a schematic diagram illustrating an exemplary structure of a folded folding chair (without a chair fabric) according to some embodiments of the present disclosure.

Numbers in the figures denote: 1, folding chair; 100, folding mechanism; 110, fixed portion; 111, chassis portion; 112, vertical projection portion; 113, fixed connection block; 114, recessed slot; 120, movable portion; 121, insertion portion; 122, horizontal projection portion; 123, rotating connection block; 130, position-limiting slot; 140, position-limiting block; 141, pressing portion; 142, position-limiting portion; 143, connection portion; 150, resilient member; 160, cover plate; 161, letting opening; 200, support mechanism; 210, connection rod; 211, support crossbar; 212, connection seat; 2121, first end portion; 2122, second end portion; 2123, hinge slot; 2124, position-limiting tab; 2125, position-limiting recessed slot; 220, lower support rod; 221, accommodation slot; 222, socket buckle; 230, an upper support rod; 240, first hinge point; 250, second hinge point; 300, chair fabric; 310, mounting member; 320, seat cushion portion; and 330, backrest portion.

DETAILED DESCRIPTION

Hereinafter, the present disclosure is further described in connection with specific embodiments, and it is to be noted that, on the premise of not conflicting, new embodiments may be formed by any combination between the embodiments described below or between various technical features.

In the description of the present application, it should be noted that, for an azimuthal term, if there is a term "center", "horizontal", "longitudinal", "length", "width", "thickness", "upper", "lower", "front", "back", "left", "right", "vertical", "horizontal", "top", "bottom", "inside", "outside", "clockwise", "counterclockwise" and so on indicate orientation and positional relationships based on the orientation or positional relationships shown in the accompanying drawings, only for the convenience of recounting the present disclosure and simplifying the description, and not to indicate or imply that the device or element referred to must have a specific orientation, be constructed and operated in a specific orientation, and cannot be construed as limiting the specific scope of protection of the present disclosure.

It should be noted that the terms "first", "second", etc., in the present disclosure and claims of the present disclosure are used to distinguish similar objects and are not intended to describe a particular order or sequence.

The terms "comprising" and "including", and any variations thereof, in the present disclosure and claims of the present disclosure are intended to cover non-exclusive inclusion, e.g., a process, method, system, product, or apparatus that includes a series of steps or units need not be limited to those steps or units that are clearly enumerated, but may include other steps or units that are not clearly enumerated or that are inherent to the process, method, product, or apparatus.

As shown in FIG. 1 to FIG. 4, the present disclosure may provide a folding chair 1, including a folding mechanism 100, at least two support mechanisms 200, and a chair fabric 300. The at least two support mechanisms 200 may be connected with the folding mechanism 100, the chair fabric 300 may be detachably connected with the at least two support mechanisms 200, and the folding mechanism 100 may be rotatable between an expanded dead point pattern and a collapsed dead point pattern to enable each of the at least two support mechanisms 200 to be in an X-shaped unfolded state or a linear folded state, thereby realizing expansion or collapse of the folding chair 1.

In some embodiments, as shown in FIG. 5 to FIG. 11, the folding mechanism 100 may include a fixed portion 110 and a movable portion 120 that are rotationally connected with each other. The movable portion 120 may rotate along a circumferential direction with respect to the fixed portion 110. The movable portion 120 may be hollow to form an accommodation space. The movable portion 120 may be provided with a position-limiting slot 130, the position-limiting slot 130 may be connected with the accommodation space. The fixed portion 110 may also be provided with a position-limiting block 140, the position-limiting block 140 may be located in the accommodation space and may slide up and down along a vertical direction relative to the fixed portion 110 and the movable portion 120, so as to make the position-limiting block 140 embedded in or disengaged from the position-limiting slot 130. When the position-limiting block 140 is embedded in the position-limiting slot 130, the position-limiting block 140 may cooperate with the position-limiting slot 130 to circumferentially limit a position of the movable portion 120 and limit the relative rotation of the movable portion 120 and the fixed portion 110, and when the position-limiting block 140 is disengaged from the position-limiting slot 130, the position-limiting block 140 may not cooperate with the position-limiting slot 130, and the movable portion 120 may rotate circumferentially relative to a fixed seat and the position-limiting block 140. A user may change a position of the position-limiting block 140 to flexibly control the relative rotation of the movable portion 120 and the fixed portion 110, so that the user may stably control whether the folding mechanism 100 is folded.

Horizontal projections of the position-limiting block 140 and the position-limiting slot 130 may be in an adapted square, so that when the movable portion 120 rotates with respect to the fixed portion 110 to enable the position-limiting block 140 to be positively aligned with the position-limiting slot 130, the position-limiting block 140 may be embedded into the position-limiting slot 130, and once the position-limiting block 140 is embedded in the position-limiting slot 130, the position-limiting block 140 and the position-limiting slot 130 may cooperate to circumferentially limit the position of the movable portion 120. Thus, a position of the position-limiting slot 130 may be preset such that the position-limiting block 140 is positively aligned with the position-limiting slot 130 only when the movable portion 120 rotates with respect to the fixed portion 110 to the expanded dead center pattern or the collapsed dead center pattern. The position-limiting block 140 may be embedded in the position-limiting slot 130 and cooperate with the position-limiting slot 130 to circumferentially limit the position of the movable portion 120, so as to maintain the folding mechanism 100 in the expanded dead center pattern or the collapsed dead center pattern.

Figure 6:
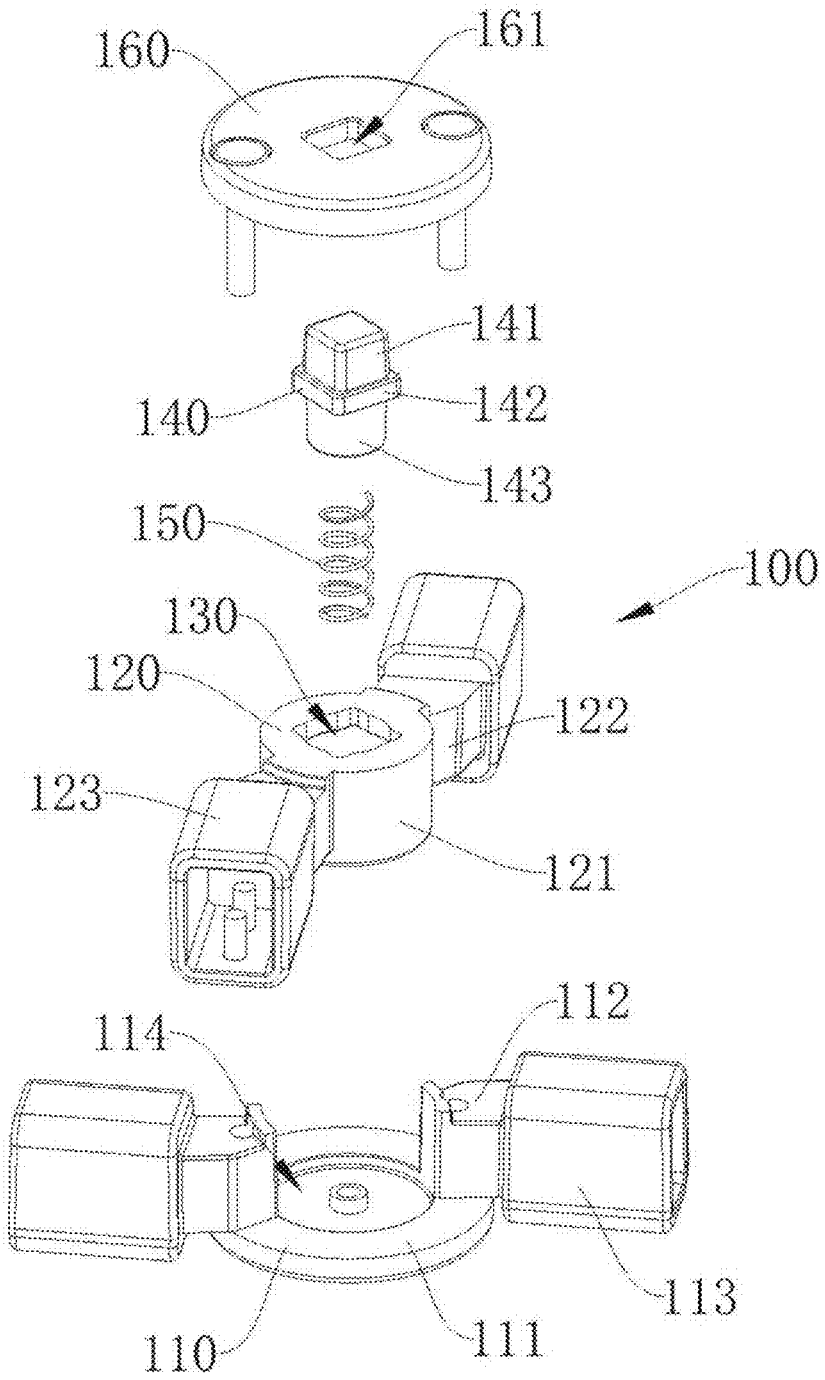
FIG. 6 is a schematic diagram illustrating an exploded structure of a folding mechanism according to some embodiments of the present disclosure.
Figure 7:
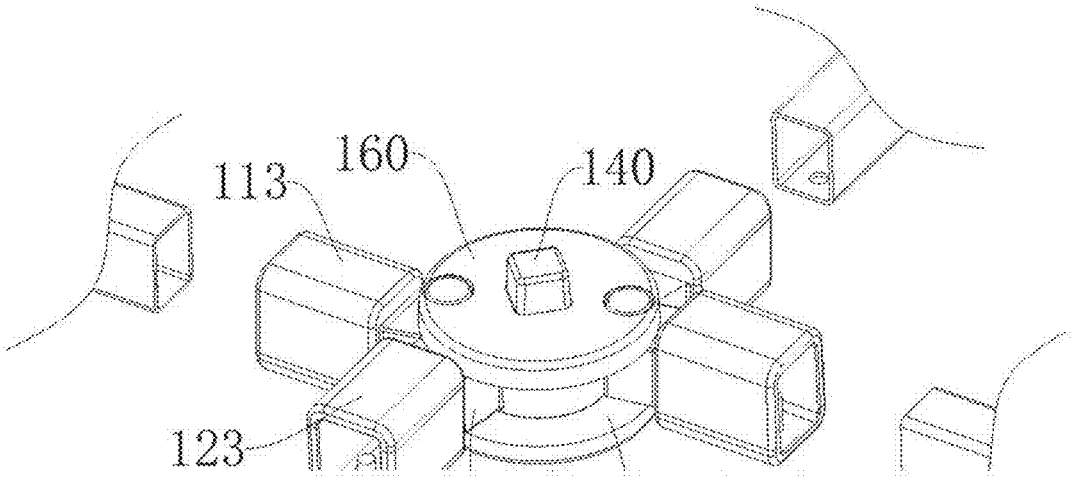
FIG. 7 is a schematic diagram illustrating a partially exploded structure of a folding mechanism and a support mechanism according to some embodiments of the present disclosure.

It is worth mentioning that shapes and structures of the position-limiting block 140 and the position-limiting slot 130 are not limited, and in an embodiment illustrated in FIG. 6, the position-limiting block 140 and the position-limiting slot 130 may be adopted in a square structure, whereas in some other embodiments, the position-limiting block 140 and the position-limiting slot 130 may also adopt a polygonal structure such as a rectangle, a triangle, or a trapezoid, or an elliptical structure.

In the embodiment illustrated in FIG. 6, the folding mechanism 100 may further include a resilient member 150, the resilient member 150 being disposed between the fixed portion 110 and the position-limiting block 140. The resilient member 150 may drive the position-limiting block 140 upwardly to enable that the position-limiting block 140 is embedded in the position-limiting slot 130 under an action of the resilient member 150, so to circumferentially limit the position of the movable portion 120 when the position-limiting block 140 is positively aligned with the position-limiting slot 130. The position-limiting block 140 may also be pressed to move downwardly to compress the resilient member 150 and disengage from the position-limiting slot 130 to release circumferential position-limitation of the movable portion 120. The resilient member 150 may be selected to be any material that has an elastic reservoir of energy and is capable of pushing the position-limiting block 140 upwardly after a compression force of the position-limiting block 140 has been removed, for example, an elastomeric rubber, an elastomeric reed, or the like. In some embodiments, the resilient member 150 may be a compression spring, with one end of the compression spring connected with the fixed portion 110, and the other end of the compression spring connected with the position-limiting block 140. When the user presses the position-limiting block 140, the position-limiting block 140 may move downwardly and detach from the position-limiting slot 130, the compression spring may be compressed and deformed, and when the user releases the position-limiting block 140, the compression spring recovers to push the position-limiting block 140 upwardly, and push the position-limiting block 140 upwardly to be embedded in the position-limiting slot 130 when the position-limiting block 140 is positively aligned with the position-limiting slot 130. The above structure effectively realizes an automatic locking function of the position-limiting block 140. When the movable portion 120 rotates relative to the fixed portion 110 to the expanded dead center pattern or the collapsed dead center pattern so that the position-limiting slot 130 is positively aligned with the position-limiting slot 130, the position-limiting block 140 may be automatically embedded in the position-limiting slot 130 to maintain the folding mechanism 100 in the expanded dead center pattern or the collapsed dead center pattern.

As shown in FIG. 6, in some embodiments, the position-limiting block 140 may specifically include a position-limiting portion 142, a pressing portion 141 located at an upper end of the position-limiting portion 142, and a connection portion 143 located at a lower end of the position-limiting portion 142. The connection portion 143 may be cylindrical and hollow to form a cavity for accommodating the resilient member 150, and the resilient member 150 may be connected with the cavity of the connection portion 143 to increase the stability of a connection between the resilient member 150 and the position-limiting block 140, and the position-limiting portion 142 may be suitable to be embedded in the position-limiting slot 130 to cooperate with the position-limiting slot 130, and the pressing portion 141 may be suitable to be pressed or released to cause the position-limiting portion 142 to move downwardly away from the position-limiting slot 130 or to move upwardly to be embedded in the position-limiting slot 130. In some embodiments, the folding mechanism 100 may further include a cover plate 160, the cover plate 160 being fixedly mounted to an upper end of the fixed portion 110, and the cover plate 160 being provided with a letting opening 161. A shape of the letting opening 161 may be adapted to the pressing portion 141, whereby only the pressing portion 141 in the position-limiting block 140 is capable of extending through the letting opening 161 to a top of the cover plate 160 to be compressed or released. The cover plate 160 and the letting opening 161 may limit the position of the position-limiting block 140, after the position-limiting portion 142 is embedded in the position-limiting slot 130, the cover plate 160 may prevent the position-limiting block 140 from further moving upward under the action of the resilient member 150, causing the position-limiting portion 142 to be disengaged from the position-limiting slot 130 and unable to limit the position of the movable portion 120.

Additionally, shapes of the pressing portion 141 and the letting opening 161 may be polygonal structures such as a square or a rectangle, or an ellipse, and an outer wall of the pressing portion 141 may abut against an inner wall of the letting opening 161, so that the position-limiting block 140 may only slide along a vertical direction relative to the cover plate 160, the movable portion 120, and the fixed portion 110, and the position-limiting block 140 may not rotate along the vertical direction or slide along a horizontal direction. As a result, when the movable portion 120 rotates with respect to the fixed portion 110, the position-limiting slot 130 may rotate with respect to the position-limiting block 140, the position-limiting portion 142 may be misaligned with the position-limiting slot 130, and the position-limiting portion 142 may not be embedded in the position-limiting slot 130 to cooperate with the position-limiting slot 130 for position-limitation, and only when the movable portion 120 rotates to the expanded dead center pattern or the collapsed dead center pattern, the position-limiting portion 142 may once again positively aligned with the position-limiting slot 130, and the position-limiting portion 142 may only be embedded in the position-limiting slot 130 to limit the position of the movable portion 120, i.e., the position-limiting block 140 only circumferentially limits the position of the movable portion 120 in the expanded dead center pattern and in the collapsed dead center pattern.

In some embodiments, the folding mechanism 100 may include two fixed connection blocks 113 and two rotating connection blocks 123, the two fixed connection blocks 113 and the two rotating connection blocks 123 may be configured to connect with the support mechanism 200, the two fixed connection blocks 113 may be mounted on the fixed portion 110, the two rotating connection blocks 123 may be mounted on the movable portion 120, the two fixed connection blocks 113 and the two rotating connection blocks 123 may be symmetrically disposed. When the movable portion 120 rotates relative to the fixed portion 110 to the expanded dead center pattern, the two fixed connection blocks 113 and the two rotating connection blocks 123 may be in an X-shaped structure, and when the movable portion 120 rotates relative to the fixed portion 110 to the collapsed dead center pattern, the two fixed connection blocks 113 and the two rotating connection blocks 123 may be in a linear structure. When the folding mechanism 100 is in the expanded dead center pattern, the two fixed connection blocks 113 and the two rotating connection blocks 123 in the X-shaped structure may make each of the two support mechanisms 200 also be set in an X-shaped structure, and improve the structural stability and reliability of each of the support mechanisms 200. When the folding mechanism 100 is in the collapsed dead center pattern, the two fixed connection blocks 113 and the two rotating connection blocks 123 in the linear structure may make each of the two support mechanism 200 also be set in a linear structure, so as to make a structure of the two collapsed support mechanisms 200 compact and take up less space.

In some embodiments, the fixed portion 110 may include a chassis portion 111, the chassis portion 111 being provided with at least one vertical projection portion 112 extending upwardly on an outer edge of the chassis portion 111, and the movable portion 120 may include an insertion portion 121, an outer wall of the insertion portion 121 being provided with at least one horizontal projection portion 122 outwardly extending. The insertion portion 121 may be rotatably mounted on the chassis portion 111, and when the insertion portion 121 rotates relative to the chassis portion 111, the horizontal projection portion 122 may be close to or away from the vertical projection portion 112. The above structure is simple and compact, cleverly designed, and highly stable.

Figure 8:
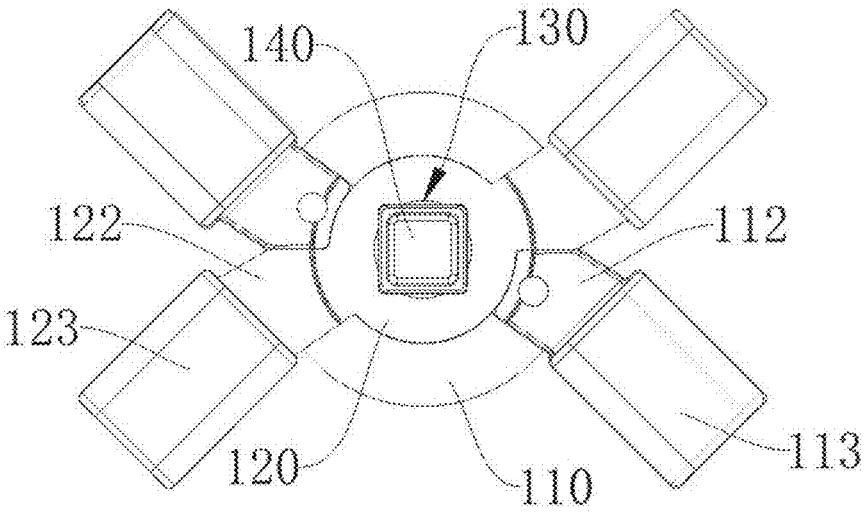
FIG. 8 is a schematic diagram illustrating a top view of a folding mechanism in an expanded dead center pattern according to some embodiments of the present disclosure.
Figure 9:
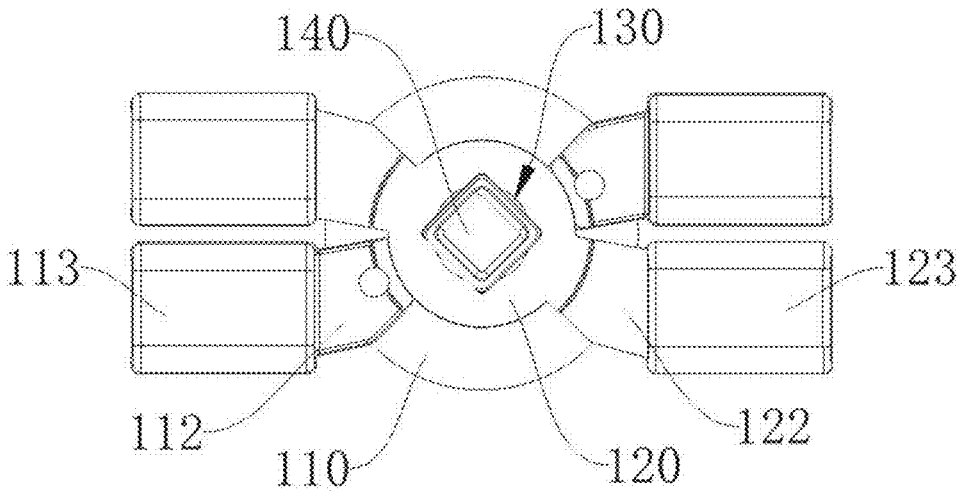
FIG. 9 is a schematic diagram illustrating a top view of a folding mechanism in a collapsed dead center pattern according to some embodiments of the present disclosure.
Figure 10:
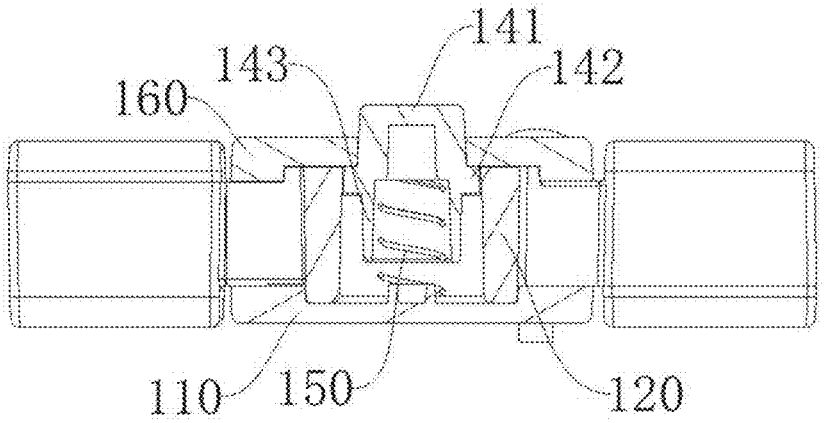
FIG. 10 is a schematic diagram illustrating a cross-sectional view of a folding mechanism according to some embodiments of the present disclosure.

As shown in FIG. 8 and FIG. 9, when the vertical projection portion 112 and the horizontal projection portion 122 are pressed against each other, the vertical projection portion 112 and the horizontal projection portion 122 may cooperate to limit relative rotation of the chassis portion 111 and the insertion portion 121, and the folding mechanism 100 may be in the expanded dead center pattern or the collapsed dead center pattern at this time, the position-limiting block 140 may be positively aligned with the position-limiting slot 130 and embedded in the position-limiting slot 130 to realize the circumferential position-limitation of the movable portion 120. That is, when the folding mechanism 100 is in the expanded dead center pattern or the collapsed dead center pattern, the vertical projection portion 112 and the horizontal projection portion 122 may be in a state of abutment, so that, in addition to the position-limiting block 140 cooperating with the position-limiting slot 130 to circumferentially limit the position of the movable portion 120, the vertical projection portion 112 and the horizontal projection portion 122 may also abut against each other to limit the movable portion 120, which improves the limiting effect and the stability of the structure.

In some embodiments, the chassis portion 111 may be provided with two vertical projection portions 112, each of the vertical projection portions 112 may be provided with a fixed connection block 113, and the insertion portion 121 may be provided with two horizontal projection portions 122, each of the horizontal projection portions 122 may be provided with a rotating connection block 123. As shown in FIG. 8, when in the expanded dead center pattern, the two fixed connection blocks 113 may be disposed at a front end and a rear end of the chassis portion 111, respectively, and the two rotating connection blocks 123 may be disposed at a left end and a right end of the chassis portion 111, respectively, to form the X-shaped structure. As shown in FIG. 9, when in the collapsed dead center pattern, the two fixed connection blocks 113 may be disposed at the left end and the right end of the chassis portion 111, respectively, and the two rotating connection blocks 123 may also be disposed at the left end and the right end of the chassis portion 111, respectively, to form the linear structure. The above-described structure reliably forms the X-shaped expanded dead center pattern and the linear collapsed dead center pattern of the folding mechanism 100.

It is worth mentioning that, in some embodiments, the chassis portion 111 may be provided with a recessed slot 114. Projections of the recessed slot 114 and the horizontal insertion portion 121 may be in form of an adapted square circle, and a lower end of the insertion portion 121 may be embedded in the recessed slot 114, thereby realizing a rotatable connection between the insertion portion 121 and the chassis portion 111. The above structure is used to realize the rotational connection between the chassis portion 111 and the insertion portion 121, and an overall structure is simple and easy to install and remove.

In some embodiments, as shown in FIG. 1 to FIG. 14, the folding chair 1 may include four support mechanisms 200, each of the support mechanisms 200 may include a connection rod 210, a lower support rod 220, and an upper support rod 230 that are disposed on a same plane. Two of the four support mechanisms 200 may be disposed on the fixed portion 110 through the cooperation of the connection rod 210 and the fixed connection block 113, and the other two of the four support mechanisms 200 may be disposed on the movable portion 120 through the cooperation of the connection rod 210 and the rotating connection block 123, so that the movable portion 120 may rotate relative to the fixed portion 110 to cause each of the four support mechanisms 200 in the X-shaped structure when the folding mechanism 100 is in the expanded dead center pattern, and to cause each of the four support mechanisms 200 in the linear structure when the folding mechanism 100 is in the collapsed dead center pattern. The X-shaped setting of each of the four support mechanisms 200 provides a more stable and reliable support effect when the support mechanism 200 is unfolded, and a linear setting of each of the four support mechanisms 200 provides a more compact and small size when the support mechanism 200 is folded.

In some embodiments, the support mechanism 200 may also be folded and unfolded, the lower support rod 220 of the support mechanism 200 may be hingedly connected with the connection rod 210 of the support mechanism 200, and the upper support rod 230 of the support mechanism 200 may be hingedly connected with the lower support rod 220 of the support mechanism 200. The lower support rod 220 may be provided with an accommodation slot 221, and the lower support rod 220 and upper support rod 230 may be adapted to rotate on a same plane with respect to the connection rod 210, so that when the support mechanism 200 is folded, the upper support rod 230 may be folded and accommodated in the accommodation slot 221, and flipped below the connection rod 210 to fit the connection rod 210 with the lower support rod 220.

In some embodiments, the lower support rod 220 may be hingedly coupled with the connection rod 210 to form a first hinge point 240, and the upper support rod 230 may be hingedly coupled with the lower support rod 220 to form a second hinged point 250, and the first hinge point 240 and the second hinge point 250 may be disposed at a same end portion of the lower support rod 220, such that a direction of rotation and folding of the lower support rod 220 relative to the connection rod 210 is the same as a direction of rotation and folding of the upper support rod 230 relative to the connection rod 210, and a direction of rotation and unfolding of the lower support rod 220 relative to the connection rod 210 is the same as a direction of rotation and unfolding of the upper support rod 230 relative to the connection rod 210. For example, as shown in FIG. 12, the lower support rod 220 and the upper support rod 230 may be rotated to fold in a clockwise direction, the lower support bar 220 and the upper support rod 230 may be rotated to unfold in a counterclockwise direction, and the lower support rod 220 and upper support rod 230 may be folded or unfolded in a same direction.

In some embodiments, the connection rod 210 may include a support crossbar 211 and a connection seat 212. The connection seat 212 may include a first end portion 2121 extending along a horizontal direction and a second end portion 2122 extending obliquely downward. An obtuse angle being formed between the first end portion 2121 and the second end portion 2122. The support crossbar 211 may be connected with the first end portion 2121, the lower support rod 220 may be hingedly connected with the second end portion 2122, and the lower support rod 220 and the upper support rod 230 may be rotatably folded inwardly to the underside of the support crossbar 211 and affixed to the support crossbar 211.

Figure 11:
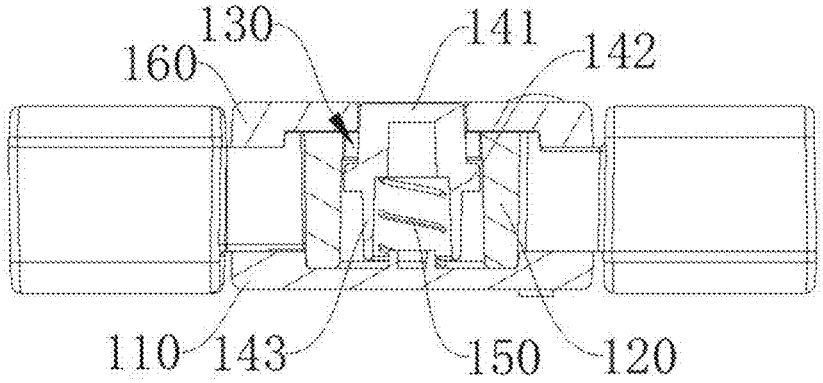
FIG. 11 is a schematic diagram illustrating a cross-sectional view of a folding mechanism in another state according to some embodiments of the present disclosure.
Figure 12:
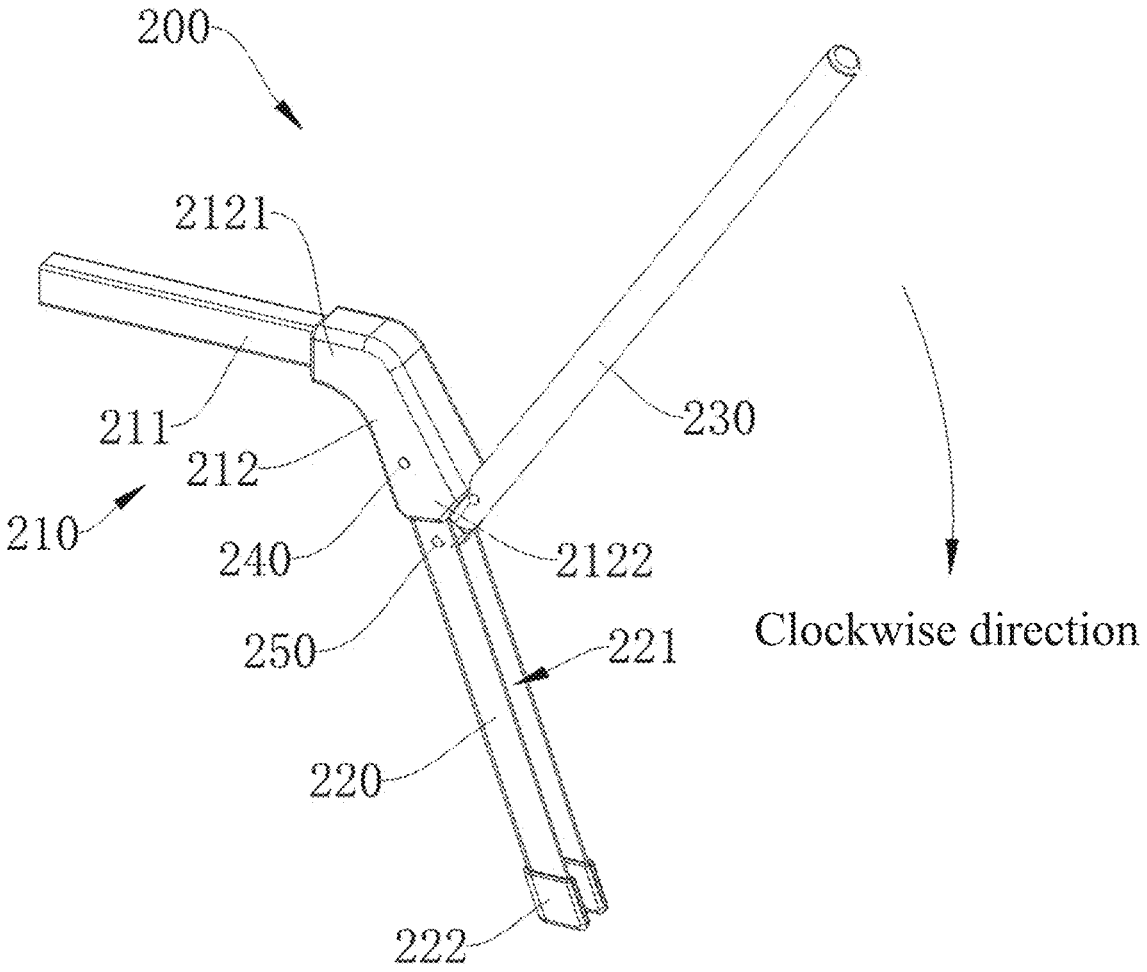
FIG. 12 is a schematic diagram illustrating an exemplary structure of an unfolded support mechanism according to some embodiments of the present disclosure.
Figure 13:
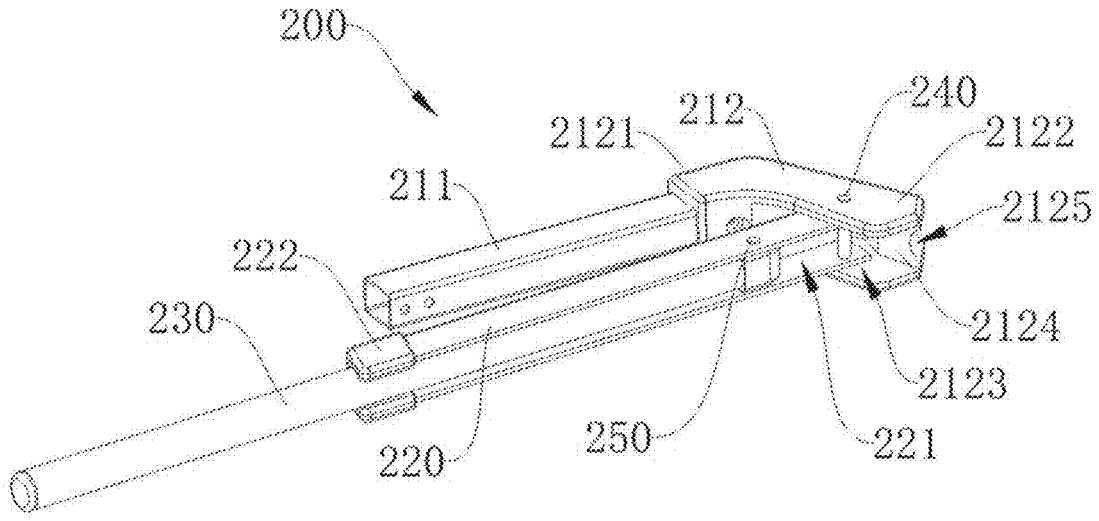
FIG. 13 is a schematic diagram illustrating an exemplary structure of a folded support mechanism according to some embodiments of the present disclosure.
Figure 14:
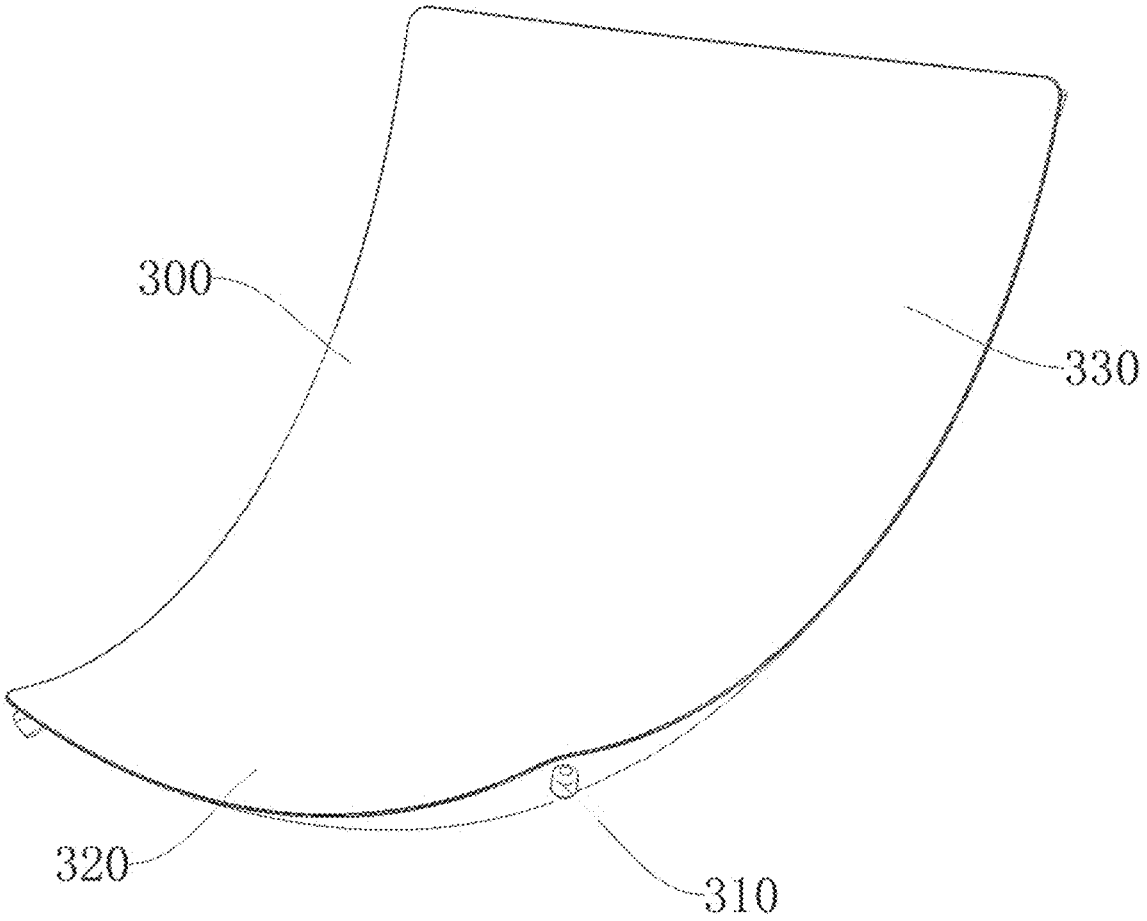
FIG. 14 is a schematic diagram illustrating an exemplary structure of a chair fabric according to some embodiments of the present disclosure.

In some embodiments, as shown in FIG. 11 to FIG. 13, in some embodiments, the support crossbar 211 may be implemented as a square-tube structure, the lower support rod 220 may be implemented as a tube structure with a shape similar to a character "⊔", and the upper support rod 230 may be implemented as a round-tube structure. One end of the support crossbar 211 may be connected with the fixed connection block 113 or the rotating connection block 123 and the other end of the support crossbar 211 may be connected with the first end portion 2121 of the connection seat 212. The support crossbar 211 may be disposed in a same straight line with the first end portion 2121, and the second end portion 2122 of the connection seat 212 may be provided with a hinge slot 2123. A hinge hole may be provided in the middle of the hinge slot 2123, and a top end of the lower support bar 220 may be hingedly attached in the hinge slot 2123 through screws cooperating with the hinge hole, so to form the first hinge point 240.

A width of the hinge slot 2123 may be the same as a width of the lower support rod 220, so that the lower support rod 220 may only be rotated within the hinge slot 2123 and may not slide within the hinge slot 2123, and the hinge slot 2123 may be provided with a position-limiting tab 2124 below the hinge point. The position-limiting tab 2124 may be adapted to abut against the lower support rod 220 to limit a maximum expanded position of the lower support rod 220, so that when the lower support rod 220 rotates to the maximum expanded position, the lower support rod 220 may abut against the position-limiting tab 2124, which limits the position of the lower support rod 220 at the maximum expanded position to prevent the lower support rod 220 from further rotating. In some embodiments, the hinge slot 2123 may be provided with a position-limiting member, such as a card block, a magnetic suction member, or the like. The position-limiting member may be used for limiting the position of the lower support rod 220 to a folded position to prevent the lower support rod 220 from rotating to expand when the folding chair 1 is in a folded state.

The lower support rod 220 may be the tube structure with a shape similar to a character "⊔", the lower support rod 220 may be provided with the accommodation slot 221, the upper support rod 230 may be hingedly connected with the lower support rod 220 to form a second hinge point 250, the second hinge point 250 and the first hinge point 240 may be disposed on a same end of the lower support rod 220. When the support mechanism 200 is folded, the upper support rod 230 may be rotatably folded into the accommodation slot 221, and when the support mechanism 200 is unfolded, the upper support rod 230 may be rotatably unfolded outside the accommodation slot 221. The second end portion 2122 of the connection seat 212 may be provided with a position-limiting recessed slot 2125 at a side end of the position-limiting tab 2124, and a shape of the position-limiting recessed slot 2125 may be suitable for a shape of the upper support rod 230. When the upper support rod 230 rotates to the maximum expanded position, the upper support rod 230 may be adapted to be embedded in the position-limiting recessed slot 2125 and cooperate with the position-limiting recessed slot 2125, henceforth limiting a position of the lower support rod 220 at the maximum expanded position.

In some embodiments, the first end portion 2121 and the second end portion 2122 of the connection seat 212 may be integrally molded to be connected, and an angle of 110 degrees may be formed between the first end portion 2121 and the second end portion 2122. When the lower support rod 220 is at the maximum expanded position, the support crossbar 211 and the first end portion 2121 may be set in a same straight line, the lower support rod 220 and the second end portion 2122 may be set in a same straight line. When the support mechanism 200 is unfolded, the lower support rod 220 may rotate to a maximum expanded angle, and an angle of 110 degrees may be formed between the lower support rod 220 and the support crossbar 211. Then the position-limiting recessed slot 2125 may extend upwardly obliquely, the upper support rod 230 may rotate to the maximum expanded position, and an angle of 125 degrees may be formed between the upper support rod 230 and the lower support rod 220. Then, the upper support rod 230 may support the chair fabric 300. Based on the above structure, when the folding chair 1 is unfolded, various support mechanisms 200 cooperate with each other to form a trapezoidal structure, and the trapezoidal structure has a good structural strength, which ensures the stability of support.

Mounting members 310 may be disposed on four corners of the chair fabric 300, and when the folding mechanism 100 is in an expanded four-point pattern and each support mechanism 200 is unfolded, each of the mounting members 310 and a free end of each upper support rod 230 may be detachably connected with each of the support mechanisms 200, and when unloaded or loaded, the chair fabric 300 may apply a force in a direction of unfolding and rotation to the free end of each upper support rod 230 to maintain the each upper support rod 230 at the maximum expanded position and ensure the stability of the support mechanism 200. In addition, projections, magnetic suction members, or the like, may be disposed in the position-limiting recessed slot 2125 to pre-fix the each upper support rod 230.

The chair fabric 300 may include a seat cushion portion 320 and a backrest portion 330. The seat cushion portion 320 and the backrest portion 330 may be both provided with the mounting member 310, the upper support rod 230 connected with the mounting member 310 on the seat cushion portion 320 may be configured as a single-tube structure with a fixed length, and the upper support rod 230 connected with the mounting member 310 on the backrest portion 330 may be configured as a multi-tube structure with an adjustable length, so as to make the chair fabric 300 have a structure in which the seat cushion portion 320 is low and the backrest portion 330 is high after being connected. In some embodiments, the upper support rod 230 in the multi-tube structure may be configured as a telescopic-tube structure, and a plurality of tubes may be sequentially socketed and telescopically snapped together by a spring snap, so that when the support mechanism 200 is unfolded, it may be adjusted to a maximum length to support the chair fabric 300, and when the support mechanism 200 is folded, it may be adjusted to a minimum length to be folded into the accommodation slot 221.

In some other embodiments, the multi-tube structure may also be configured as a folded-tube structure, a combined structure with a tube and an elastic cord, or the like. However, the folded-tube structure and the combined structure with a tube and an elastic cord, after being adjusted to a minimum length, may include a plurality of tubes set side by side, which is larger in size and a required accommodation slot 221 may also be larger, while a telescopic-tube structure may include only one tube after being adjusted to a minimum length, which is compact and makes an overall size of the support mechanism 200 more compact after folding.

Figure 5:
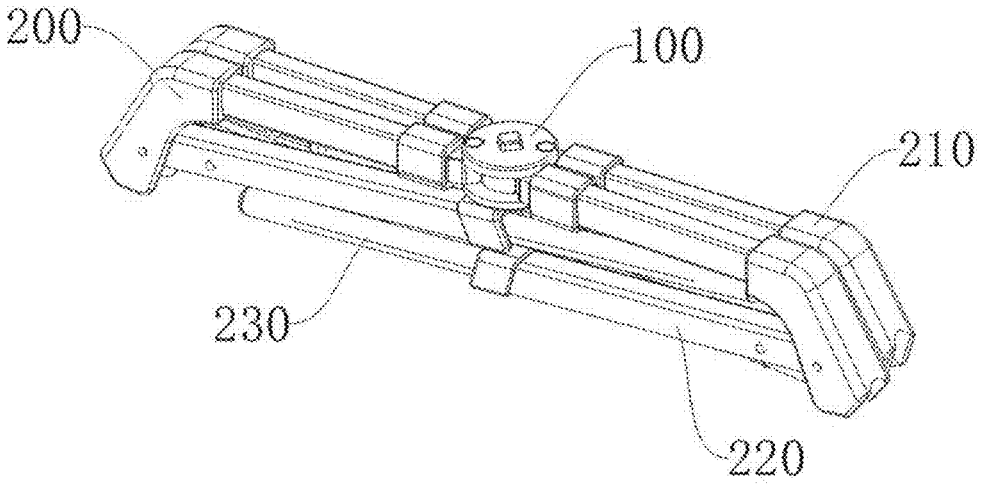
FIG. 5 is a schematic diagram illustrating a front view of a folding chair (without a chair fabric) according to some embodiments of the present disclosure.

In some embodiments, as shown in FIG. 5, a length D of the lower support rod 220, a length L of the upper support rod 230 of the single-tube structure, and a minimum length S of the upper support rod 230 of the multi-tube structure may be not greater than a distance M between the two first hinged points 240 in the two support mechanisms 200 symmetrically disposed at two ends of the folding mechanism when each of the support mechanisms is in the linear structure, i.e., $D \leq M$, $L \leq M$, $S \leq M$, to ensure that the lower support rod 220 and the upper support rod 230 may be flipped to the underside of the folding mechanism 100 and the support crossbar 211, and affixed to the folding mechanism 100 and the support crossbar 211.

In this embodiment, the length L of the upper support rod 230 of the single-tube structure and the minimum length S of the upper support rod 230 of the multi-tube structure may be greater than the length D of the lower support rod 220, so that when the support mechanism 200 is folded, a portion of the upper support rod 230 may extend outside the accommodation slot 221 of the lower support rod 220. A free end of the lower support rod 220 may be provided with a socket buckle 222. In addition to being suitable for contacting with a placement plane to serve as a slip-prevention foot pad, the socket buckle 222 may be configured to limit a position of the upper support rod 230. Specifically, the socket buckle 222 may be provided with a snap-fit protrusion, the snap-fit protrusion being adapted to detachably snap with the upper support rod 230 to keep the upper support rod 230 within the accommodation slot 221 when an external force does not exceed a preset value. In some embodiments, if the length L of the upper support rod 230 is less than the length D of the lower support rod 220, the socket buckle 222 may be disposed in the middle of the lower support rod 220 to enable the lower support rod 220 to snap-fit with the upper support rod 230, the free end of the lower support rod 220 may be provided with another foot pad, and a setting position of the socket buckle 222 may be freely adjusted according to the length L of the upper support rod 230.

Operations of collapsing the folding chair of the present disclosure may be as follows.

Operation 1, the chair fabric 300 may be removed from the support mechanism 200.

Operation 2, the pressing portion 141 of the position-limiting block 140 may be pressed, and the position-limiting block 140 may move downwardly and compress the resilient member 150 under an action of an external force, so that the position-limiting portion 142 may detach from the position-limiting recessed slot 130, and the movable portion 120 may be unlocked.

Operation 3, the movable portion 120 may rotate to the collapsed dead center pattern, so that each support mechanism 200 may be located at two ends of the fixed portion 110 in the linear structure, the position-limiting portion 142 may be positively aligned with the position-limiting recessed slot 130, the position-limiting block 140 may move upwardly under an action of the resilient member 150, and the position-limiting block 140 may be automatically embedded in the position-limiting slot 130 to relock the movable portion 120.

Operation 4, the support mechanism 200 at the two ends of the fixed portion 110 may be folded, and the upper support rod 230 and the lower support rod 220 at the two ends may rotate and be flipped in turn to the underside of the support crossbar 211 and the folding mechanism 100 to be affixed to the support crossbar 211 and the folding mechanism 100 to complete the collapse of the folding chair 1.

Operations of expanding the folding chair of the present disclosure may be as follows.

Operation 1, the pressing portion 141 of the position-limiting block 140 may be pressed, the position-limiting block 140 may move downwardly and compress the resilient member 150 under the action of the external force, so that the position-limiting portion 142 may detach from the position-limiting slot 130, and the movable portion 120 may be unlocked.

Operation 2, the movable portion 120 may rotate to the expanded dead center pattern, so that each support mechanism 200 located at the two ends of the fixed portion 110 may be in the X-shaped structure, the position-limiting portion 142 may be positively aligned with the position-limiting slot 130, the position-limiting block 140 may move upwardly under the action of the resilient member 150, and the position-limiting portion 142 may be automatically embedded in the position-limiting slot 130 to relock the movable portion 120.

Operation 3, the support mechanism 200 at the two ends of the fixed portion 110 may be expanded, the upper support rod 230 and the lower support rod 220 at the two ends may rotate and be flipped in turn to the maximum expanded position.

Operation 4, the chair fabric 300 may be mounted on the support mechanism 200 to complete the expansion of the folding chair 1.

In the process of expanding and collapsing the folding chair 1, the user only needs to perform three operations including: pressing the position-limiting block 140, rotating the movable portion 120, and then rotating the upper support rod 230 and the lower support rod 220. There is no need for external tools such as a screwdriver, a wrench, etc., and there is no need to disassemble or install rods with the whole operation process being simple and convenient. The folded folding chair 1 is in the linear structure, which is compact, occupies a very small required space, and is convenient for the user to carry and store, and the unfolded folding chair 1 is in the X-shaped structure, which is stable and reliable, and can provide a rest space for the user to sit and lie down.

The above describes the basic principles of the present disclosure, the main features, and the advantages of the present disclosure. The person skilled in the art should understand that the present disclosure is not limited by the above embodiments, and what has been described in the above embodiments and the present disclosure is only the principle of the present disclosure and that the present disclosure will also have various changes and improvements on the premise that it does not deviate from the spirit and scope of the present disclosure, which falls within the scope of the present disclosure for protection. The scope of protection claimed in the present disclosure is defined by the appended claims and their equivalents.

What is claimed is:

1. A folding chair, comprising a chair fabric, a folding mechanism, and at least two support mechanisms, wherein the folding mechanism includes a fixed portion and a movable portion that are rotationally connected with each other, and each of the at least two support mechanisms includes a connection rod, a lower support rod, and an upper support rod that are disposed on a same plane, one end of the connection rod is connected with the fixed portion or the movable portion, the other end of the connection rod is hingedly connected with the lower support rod, the upper support rod is hingedly connected with the lower support rod, the lower support rod is provided with an accommodation slot, and the movable portion is capable of circumferentially rotating to an expanded dead center pattern or a collapsed dead center pattern relative to the fixed portion, so as to enable each of the at least two support mechanisms to expand to support the chair fabric or collapse to present a linear structure;

when the movable portion of the folding mechanism is in the expanded dead center pattern, the lower support rod is disposed diagonally downwardly, and the upper support rod is disposed diagonally upwardly to support the chair fabric; and when the movable portion of the folding mechanism is in the collapsed dead center pattern, the upper support rod is collapsed into the accommodation slot and rotationally affixed to the connection rod with the lower support rod such that the connection rod, the lower support rod, and the upper support rod are disposed in the same plane.

2. The folding chair of claim 1, wherein the lower support rod is hingedly connected with the connection rod to form a first hinge point, the lower support rod is hingedly connected with the upper support rod to form a second hinge point, and the first hinge point and the second hinge point are located at a same end portion of the lower support rod such that a direction of rotation and folding of the lower support rod relative to the connection rod is the same as a direction of rotation and folding of the upper support rod relative to the connection rod.

3. The folding chair of claim 2, wherein the connection rod includes a support crossbar and a connection seat, the connection seat including a first end portion extending along a horizontal direction and a second end portion extending obliquely downward, an obtuse angle being formed between the first end portion and the second end portion, the support crossbar being connected with the first end portion, the lower support rod being hingedly connected with the second end portion, and when the support mechanism is collapsed, the lower support rod and the upper support rod being rotatably folded inwardly to an underside of the support crossbar and being affixed to the support crossbar.

4. The folding chair of claim 3, wherein the second end portion is provided with a position-limiting tab, the position-limiting tab being adapted to engage the lower support rod to limit a maximum expanded position of the lower support rod, such that when the lower support rod is at the maximum expanded position, the lower support rod and the second end portion are in a same straight line.

5. The folding chair of claim 3, wherein the second end portion is provided with a position-limiting recessed slot, a shape of the position-limiting recessed slot being adapted to a shape of the upper support rod, so that when the upper support rod rotates to a maximum expanded position, the upper support rod is adapted to be embedded in the position-limiting recessed slot and abuts against the position-limiting recessed slot to limit the maximum expanded position of the upper support rod.

6. The folding chair of claim 3, wherein the lower support rod is provided with a socket buckle, the socket buckle being provided with a snap-fit protrusion, the snap-fit protrusion being detachably snap-fitted with the upper support rod and being configured to retain the upper support rod within the accommodation slot when an external force does not exceed a preset value.

7. The folding chair of claim 3, wherein the upper support rod is configured as a single-tube structure with a fixed length; or the upper support rod is configured as a multi-tube structure with an adjustable length.

8. The folding chair of claim 7, wherein the chair fabric is provided with one or more mounting members, such that when the folding mechanism is in the expanded dead center pattern, each of the at least two support mechanisms is expanded, each of the one or more mounting members and each upper support rod are detachably connected and disposed on the each of the at least two support mechanisms, and the chair fabric is configured to exert a force on a connection end of the each upper support rod and the each of the one or more mounting members to maintain the upper support rod at a maximum expanded position.

9. The folding chair of claim 8, wherein the chair fabric includes a seat cushion portion and a backrest portion, the seat cushion portion and the backrest portion being provided with the one or more mounting members, the upper support rod connected with the mounting member on the seat cushion portion being configured as the single-tube structure with the fixed length, the upper support rod connected with the mounting member on the backrest portion being configured as the multi-tube structure with the adjustable length, and a maximum expanded length of the upper support rod of the multi-tube structure is greater than a maximum expanded length of the upper support rod of the single-tube structure.

10. The folding chair of claim 9, wherein a length D of the lower support rod, a length L of the upper support rod of the single-tube structure, and a minimum length S of the upper support rod of the multi-tube structure are not greater than a distance M between the two first hinged points in the two support mechanisms symmetrically disposed at two ends of the folding mechanism when the each of the two support mechanisms is in a linear structure.

11. The folding chair as claimed in claim 1, wherein a position-limiting block is movably disposed on the fixed portion, the position-limiting block being configured to be embedded into a position-limiting slot for circumferentially limiting a position of the movable portion when the movable portion is in the expanded dead center pattern or the collapsed dead center pattern to maintain the folding mechanism in the expanded dead center pattern or the collapsed dead center pattern.

12. The folding chair of claim 11, wherein the folding mechanism includes a resilient member, the resilient member being disposed between the fixed portion and the position-limiting block, one end of the resilient member being fixedly connected with the fixed portion, and the other end of the resilient member being fixedly connected with the position-limiting block, the resilient member being configured to drive the position-limiting block to move upwardly to enable the position-limiting block to enter the position-limiting slot under an action of the resilient member when the position-limiting block and the position-limiting slot are in proper alignment; and the position-limiting block is capable of moving downwardly to compress the resilient member and disengage from the position-limiting slot under an action of an external force.

13. The folding chair of claim 12, wherein the position-limiting block includes a position-limiting portion, a pressing portion located at an upper end of the position-limiting portion, and a connection portion located at a lower end of the position-limiting portion, the connection portion being of a cylindrical structure and being internally hollow to form a cavity for accommodating the resilient member, whereby one end of the resilient member is disposed within the cavity, and the other end of the resilient member is disposed in the fixed portion, and the pressing portion is used to be pressed or released to cause the position-limiting portion to move downwardly out of the position-limiting slot or upwardly embedded within the position-limiting slot.

14. The folding chair of claim 13, wherein horizontal projections of the position-limiting portion and the position-limiting slot are in forms of an adapted polytope or ellipse.

15. The folding chair of claim 13, wherein a cover plate is disposed on a top of the fixed portion, the cover plate is provided with a letting opening, and a shape of the letting opening fits with the pressing portion, whereby only the pressing portion in the position-limiting block is capable of extending through the letting opening to a top of the cover plate, and the position-limiting portion is limited within the position-limiting slot by abutting against the cover plate.

16. The folding chair of claim 12, wherein the folding mechanism includes two fixed connection blocks and two rotating connection blocks, the two fixed connection blocks being mounted on the fixed portion, the two rotating connection blocks being mounted on the movable portion; when the movable portion rotates relative to the fixed portion so that the folding mechanism is in the expanded dead center pattern, the two fixed connection blocks and the two rotating connection blocks are combined to form an X-shaped structure, and the position-limiting block and the position-limiting slot are in proper alignment; and when the movable portion rotates relative to the fixed portion so that the folding mechanism is in the collapsed dead center pattern, the fixed connection block and the rotating connection block are combined to form a linear structure, the position-limiting block and the position-limiting slot being in proper alignment.

17. The folding chair of claim 12, wherein the fixed portion includes a chassis portion, the chassis portion being provided with at least one vertical projection portion extending upwardly on an outer edge of the chassis portion, the movable portion including an insertion portion, an outer wall of the insertion portion being provided with at least one horizontal projection portion outwardly extending; the insertion portion being rotatably mounted on the chassis portion, and when the insertion portion rotates relative to the chassis portion, the at least one horizontal projection portion being close to or away from the at least one vertical projection portion.

18. The folding chair of claim 17, wherein when the at least one horizontal projection portion abuts against the at least one vertical projection portion, the at least one horizontal projection portion and the at least one vertical projection portion cooperate to limit a relative rotation of the chassis portion and the insertion portion, the folding mechanism is in the expanded dead center pattern or the collapsed dead center pattern, and the position-limiting block and the position-limiting slot are in proper alignment.

19. The folding chair of claim 18, wherein two of the vertical projection portions are disposed on the chassis portion, each of the two vertical projection portions is provided with a fixed connection block, two of the horizontal projection portions are disposed on the insertion portion, each of the two horizontal projection portions is provided with a rotating connection block; when the folding mechanism is in the expanded dead center pattern, two fixed connection blocks are disposed at a front end and a rear end of the chassis portion, respectively, and two rotating connection blocks are disposed at a left end and a right end of the chassis portion, respectively, thus forming an X-shaped structure; when the folding mechanism is in the collapsed dead center pattern, the two fixed connection blocks are disposed at the front end and the rear end of the chassis portion, respectively, and the two rotating connection blocks are disposed at the front end and the rear end of the chassis portion, respectively, thus forming a linear structure.

20. The folding chair of claim 17, wherein the chassis portion is provided with a recessed slot, a projection of the recessed slot is in a form of a circle and a projection of the insertion portion is in a form of a square, and a lower end of the insertion portion is inserted into the recessed slot to rotatably connect the insertion portion with the chassis portion.

* * * * *